US008229150B2

(12) United States Patent
Vonlanthen et al.

(10) Patent No.: US 8,229,150 B2
(45) Date of Patent: Jul. 24, 2012

(54) HEARING DEVICE WITH DETACHABLE MICROPHONE

(75) Inventors: Andi Vonlanthen, Oberrohrdorf (CH); Bruno Gabathuler, Grueningen (CH)

(73) Assignee: Phonak AG, Staefa (CH)

( * ) Notice: Subject to any disclaimer, the term of this patent is extended or adjusted under 35 U.S.C. 154(b) by 275 days.

(21) Appl. No.: 12/532,240

(22) PCT Filed: Mar. 27, 2007

(86) PCT No.: PCT/EP2007/052933

§ 371 (c)(1), (2), (4) Date: Sep. 21, 2009

(87) PCT Pub. No.: WO2008/116499

PCT Pub. Date: Oct. 2, 2008

(65) Prior Publication Data

US 2010/0128915 A1 May 27, 2010

(51) Int. Cl.
*H04R 25/00* (2006.01)

(52) U.S. Cl. ..... 381/324; 381/322; 381/325; 381/328; 381/366; 29/896.21

(58) Field of Classification Search ..... 381/324, 381/322, 366, 328, 325
See application file for complete search history.

(56) References Cited

U.S. PATENT DOCUMENTS

| | | | | |
|---|---|---|---|---|
| 2,833,868 | A | 5/1958 | Kojis et al. | |
| 3,048,668 | A | 8/1962 | Weiss | |
| 2003/0179894 | A1 * | 9/2003 | Saltykov | 381/313 |
| 2006/0034473 | A1 | 2/2006 | Halteren | |

OTHER PUBLICATIONS

International Search Report for PCT/EP2007/052933, dated Jan. 9, 2008.
Written Opinion for PCT/EP2007/052933, dated Jan. 9, 2008.

* cited by examiner

*Primary Examiner* — Brian Ensey
*Assistant Examiner* — Taunya McCarty
(74) *Attorney, Agent, or Firm* — Pearne & Gordon LLP

(57) ABSTRACT

The present hearing device with at least one microphone (1) arranged within the housing of the hearing device, wherein the microphone (1) is arranged within a mounting plate (4) of the hearing device, an opening (3) for receiving the microphone (1) is inventively provided within said mounting plate (4) and further elastic material (2) is arranged in at least a part area between said microphone (1) and the wall of said opening (3) facing said microphone (1). The elastic material (2) is providing a clamping action or friction fit that reliably fixes the microphone (1) in its built-in position within the mounting plate (4) or the opening (3) respectively.

16 Claims, 3 Drawing Sheets

HEARING DEVICE WITH DETACHABLE MICROPHONE

The present invention relates to a hearing device according to the preamble of claim 1, a microphone according to the preamble of claim 12 and to a method for mounting a microphone according to the preamble of claim 15 or claim 16 respectively.

The term hearing device shall be understood as a device to be worn at the vicinity or directly within the ear of a person to improve the individual hearing capacity of this person. Such an improvement may include the prevention of the receiving of certain acoustic signals in terms of ear protection. In relation to the application of such hearing devices they can be worn behind the ear (BTE), within the ear (ITE) or completely within the ear (CIC).

Such hearing devices normally comprise of at least one microphone as acoustic receiving element, a speaker as acoustic output element and an electronic element connected with said microphone and said speaker for the processing and inducement of electronic signals. This electronic element may comprise analogue or digital signal processing devices.

Said elements are usually arranged within at least one shell of the hearing device.

Hearing devices of the type of in-the-ear (ITE) usually provides a so called faceplate, a module that is substantially rigid and provides the side facing to the outside of the hearing device, together with a shell, connected firmly with the faceplate and having its shape adapted to the shape of the ear canal of the respective user of the hearing device comprising of soft or smooth material. Faceplate and shell together are thus forming the housing of ITE hearing devices.

Microphones of such ITE hearing devices are most commonly connected to the faceplate either directly by adhesive sealing or indirectly by mounting within a separate pocket of elastic material. On one hand, the microphone will thus be ruggedly fixed to avoid a loosening of the microphone in case of falling off to the ground for instance, and on the other hand to easily detach the connection of the microphone with the faceplate in case of a replacement action.

The physical requirements of the mounting parts are thus very high as they have to be mechanical stable, acoustical tight and have to be detachable without any damaging of the microphone and or faceplate respectively. This regularly leads to the use of an extensive bonding technique in view of dimensioning and handling or to the use of separate pockets with the drawback of needing extensive additional space within the miniaturized hearing device.

The problem of the present invention was to find a hearing device allowing on one hand an easy removing of the microphone and on the other hand providing a stable and acoustical tight attachment of the microphone with the hearing device.

This problem will be inventively solved by the features according to claim 1. Further inventive embodiments of the present invention result from the features of the further claims 2 to 11.

For a hearing device with at least one microphone arranged within the housing of the hearing device, wherein the microphone is arranged within a mounting plate of the hearing device, an opening for receiving the microphone is inventively provided within said mounting plate and further elastic material is arranged in at least a part area between said microphone and the wall of said opening facing said microphone. The elastic material is providing a clamping action that reliably fixes the microphone in its built-in position within the mounting plate or the opening respectively. An unintentional removal or loosening of the microphone from its built-in position will therefore be reliably prevented even under mechanical stress such as dropping the hearing device to the ground. Furthermore, an easy replacement or removal action is enabled without the need of tearing down or destroying any connection structure of the microphone. Thus, the assembling or disassembling of the microphone will be performed without the need of any tool only by hand or by a handling robotics.

For instance the elastic material is provided in form of at least one band or ring embracing said microphone. Such a band or ring is produced easy an efficiently in high quantities and is applied easily onto the microphone.

Alternatively, the elastic material is for instance provided in form of at least one band or ring preferably embracing the periphery of the cross section and arranged in the area of said wall of said opening. The band or ring will be arranged as well in the area of the opening preliminarily of the mounting of the microphone and thus enabling the direct insertion of the microphone into this opening without any pre-assembling.

For instance said band or ring provides a round or angular cross section. An angular cross section enables an accurate and precise positioning of the band or rings whereas a round cross section allows a rationalized production and is universal with respect to the positioning of the band or ring.

The microphone is provided for instance in form of a cubical shaped module. This enables an easy and accurate positioning of the microphone.

The inlet cross section of said opening is for instance greater then the cross section of said microphone and said elastic material is arranged in the area of the inlet cross section in its built-in state. The microphone will thus be easily inserted into the opening without being accurately adjusted or aligned at the beginning of this insertion action. The elastic material will thus adapt to the contour or shape of the spacing between the wall of the opening and the wall of the microphone and thereby sealing this spacing.

The pockets or grooves are for instance provided within the wall of said opening for receiving the elastic material, whereby at least one part of the cross section of the elastic material is extending into the opening cross section of said opening.

The groove is for instance provided as an open, embracing groove facing up towards the insertion direction of the microphone. The elastic material will thus be easily inserted from the upside, e.g. from the insertion side, into the groove, either separated from the microphone or together with the microphone.

The engaging means are for instance arranged in the area of said opening to resiliently engage with the microphone in its built-in state. An additional locking of the microphone in its built-in state will thus be achieved to prevent reliably any unintentional or accidental falling out or tearing out of the microphone.

The engaging means for example comprise of a tongue resiliently facing outward from said mounting plate having a hook facing towards the opening cross section of said opening. The tongue will be represented as a separate part of the mounting plate or will be an integrated part of the mounting plate itself. By inserting the microphone into the opening the tongue will self-dependently bend back and will for instance snap into a nut or recess provided at the microphone in the end or final position of the microphone. Thus, the tongue only has to be re-bent to disable the snap-effect for the disassembling of the microphone.

The mounting plate is for instance provided by the faceplate of an in-the-ear hearing device. In-the-ear hearing devices (ITE) provide regularly a faceplate for receiving the microphone within an opening of the faceplate.

The problem will be further solved by a microphone according the features according to claim 12. Further inventive embodiments result from the features of the further claims 13 and 14.

The microphone for a hearing device has at least one band or ring of elastic material embracing said microphone. The microphone will be detachably held by this band or ring within its opening of the hearing device. The cross section of the insertion aperture is preferably greater than the cross section of the microphone intended to be inserted within this opening thus providing spacing between the microphone and the wall of the opening. The ring or band will thus be positioned within this spacing and will provide by its elasticity a contact pressure onto the wall of the microphone thereby retaining the microphone in its position within the opening. By applying a suitable traction force from the outside onto the microphone it may be easily extracted from the opening to be removed or replaced if required.

At least one part of the cross section of said band or ring is for instance protruding out of the cross section of said microphone. This provides an elastic surface to be moved against the wall of the opening for the microphone and to produce the contact pressure mentioned above for the retaining and fixing of the position of the microphone.

The band or ring is for instance provided in form of a bulge made out of elastic plastic material protruding from the outside of the housing of said microphone and at least partly extending along the periphery of the housing of said microphone. The elastic surface will thus be provided by an easy to manufacture element that will be easily applied to the microphone.

The problem will be further inventively solved by the features of the method according to claim 15 or claim 16.

The method for mounting a microphone within a hearing device is inventively characterized by the following steps:

sliding on an elastic band or ring over said microphone;

sliding in said microphone provided with said band or ring into an opening of the hearing device, thereby sliding said elastic band or ring into the area of said opening.

The elastic band or the elastic ring respectively will be easily slid onto the microphone or the housing of the microphone. The band or ring will preferably be positioned in the mid-area of the microphone. The microphone together with the band or ring respectively will then subsequently be inserted into the insertion aperture of the hearing device. The insertion aperture is for instance provided as a pocket at the underside, e.g. the inner side, of a faceplate of an ITE hearing device. The cross section of the insertion aperture in the area of the opening is slightly greater than the cross section of the microphone. The microphone may thus be inserted together with the band or ring respectively into the insertion aperture, whereby the band or ring respectively will be slid between the microphone and the wall of the opening and thereby slightly pressed together. This causes a contact pressure onto the microphone or the housing of the microphone respectively resulting in a friction fit between microphone and mounting plate, thereby retaining or fixing the microphone in this position.

The microphone will simply be removed from the opening if required by simply pulling on the upper side of the microphone, for instance very easy if a part of the microphone protrudes from the surface of the mounting plate in its built-in state.

A further method for mounting a microphone within a hearing device, whereby said microphone will be mounted into an opening of a mounting plate of the hearing device, is inventively characterized by the following steps:

inserting of an elastic band or ring into the opening;

sliding in said microphone into the inlet cross section provided by said band or ring within said opening.

As already mentioned above, the same friction fit will be provided by the band or ring respectively to retain or fix the microphone in its position. Any common or known microphone may be used for this method.

One advantage of the present invention lies in the fact that practical no additional space is needed for the retaining or fixing of the microphone beside of a small spacing for the positioning of the band or ring respectively.

In contrast to the use of adhesives for attaching the microphone, the connection of the microphone with the mounting plate will be non-destructively detached and there are no vapors or adhesive residues that may penetrate into the microphone and thereby damaging or destroying the microphone. Furthermore, the embracing ring provides an acoustic sealing preventing the development of feedback or other acoustical impairments.

For purpose of facilitating and understanding of the present invention, there is illustrated in the accompanying drawings preferred embodiments thereof to be considered in connection with the following description. Thus the invention may be readily understood and appreciated.

FIG. 1 is showing the view of an inventive microphone 1 for a hearing device. The microphone 1 has for instance a substantially cubical shaped housing with rectangular cross sections.

An elastic ring 2 as one embodiment of the present invention is arranged around the microphone 1. This ring 2 is for instance arranged approximately in the mid-area of the microphone 1 in a plane perpendicular with respect to the insertion direction A.

Figure 1:
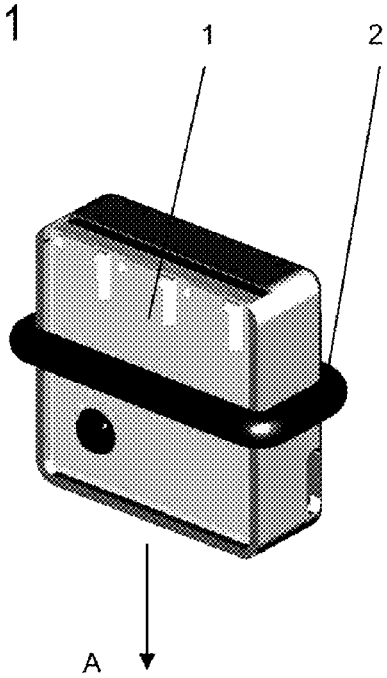
FIG. 1 is a schematic view of an inventively shaped microphone.
Figure 2:
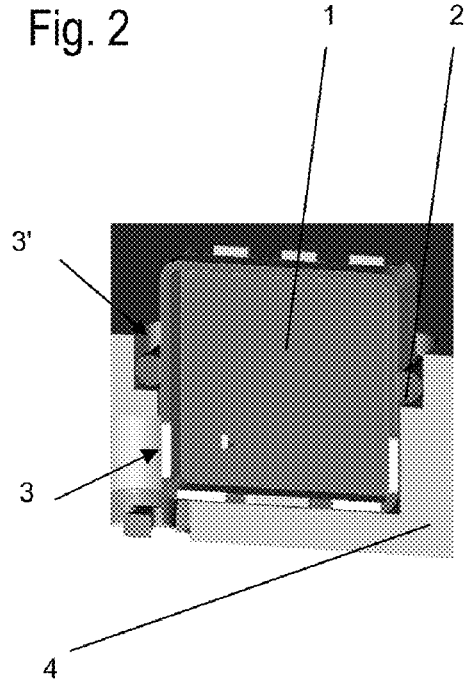
FIG. 2 is a schematic longitudinal section of the microphone of FIG. 1 in its built-in state.

Such an equipped microphone 1 will be inserted in insertion direction A into an opening 3 of faceplate 4 of a hearing device as depicted in FIG. 2 in a longitudinal section. Faceplate 4 is for instance the faceplate of an ITE hearing device and the opening 3 is arranged at the inner side of faceplate 4.

The opening 3 provides for instance in the area of the insertion aperture a groove 3' opened in direction of the insertion aperture for receiving the ring 2 in the built-in state of microphone 1.

Ring 2 provides in this embodiment a circular cross section with a diameter that is slightly greater than the clearance of spacing S between the outer wall of microphone 1 and the wall of groove 3' of the opening 3. Thus ring 2 will be slightly presses together sideways and therefore applies a contact pressure onto said walls which leads to a friction fit between the microphone 1 and the opening 3 thereby retaining and fixing microphone 1 in its inserted position. The lower part of microphone 1 thereby contacts practically the lower area of opening 3 and will therefore be exactly positioned.

Figure 3:
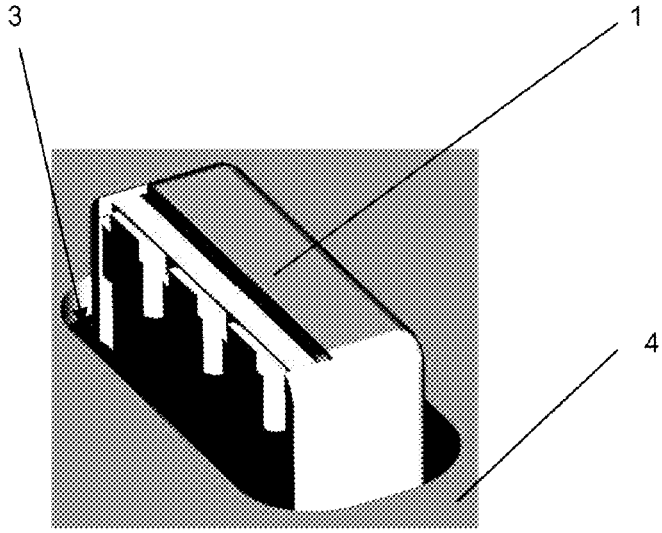
FIG. 3 is a schematic oversight onto the built-in microphone.

FIG. 3 depicts the microphone 1 in its built-in state in the upper view onto faceplate 4 or the inner side of faceplate 4 respectively. It may be appreciated that the upper side of microphone 1 is free protruding into the ambient and thus accessible for a subsequent removal process.

Figure 4:
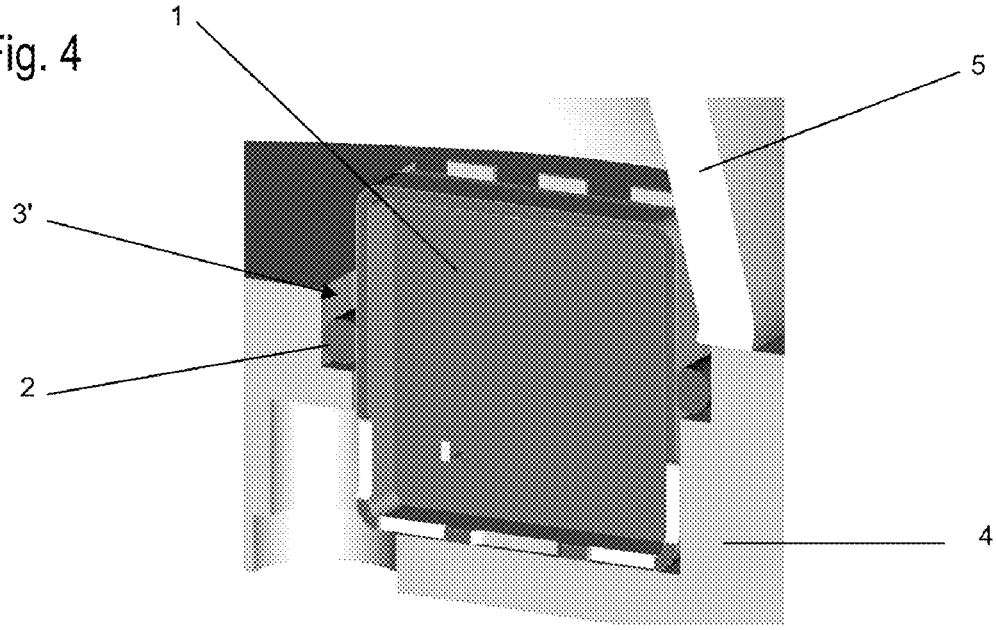
FIG. 4 is a schematic longitudinal section according to FIG. 2 with the shell attached to the faceplate.

FIG. 4 depicts again the longitudinal section according to FIG. 2 with the shell 5 attached to faceplate 4 of the ITE hearing device. The shell 5 is thereby arranged tight to the microphone 1 as may be seen out of FIG. 4 even a slight overlapping of the area of the opening area of groove 3' of opening 3 is possible. Thus, the gain of additional space for the individual shape of shell 5 will be achieved beside of an easy attachment of microphone 1 within faceplate 4, thus enabling the application of the inventive features even for complex and strong curved ear canals.

Figure 5:
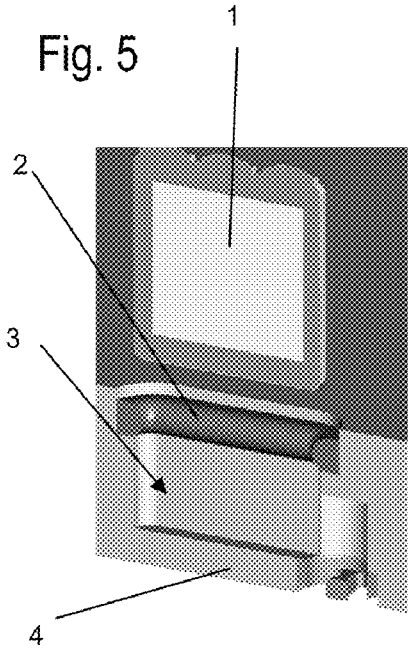
FIG. 5 is a schematic longitudinal section of an alternative embodiment of an inventive hearing device prior to the mounting of the microphone.

FIG. 5 depicts an alternative embodiment in a schematic longitudinal section. The opening 3 is provided analog to the opening 3 of FIG. 2 as a pocket with a groove 3' opened towards the insertion aperture. The ring 2 is inserted into this groove 3' preliminary to the insertion of microphone 1 into the opening 3. The ring 2 is simply slid into its position or is attached to the wall of the opening 3 or the groove 3' respectively by adhesives. Alternatively, the ring 2 may be constituted by an additional plastic layer provided onto faceplate 4, preferably as an elastic or soft plastic layer.

Figure 6:
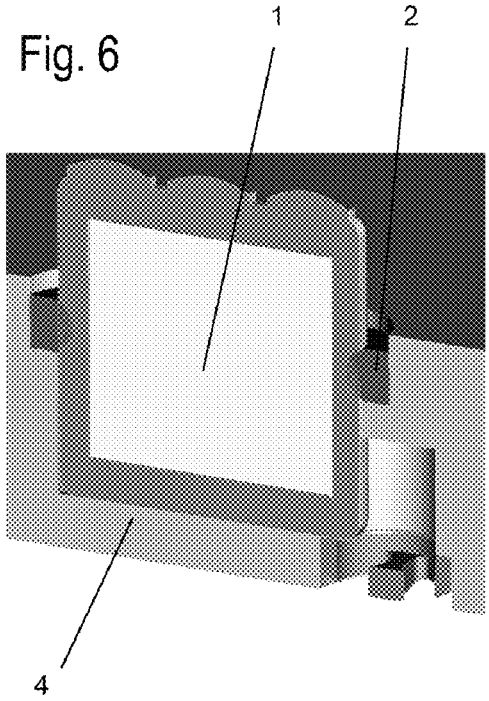
FIG. 6 is a schematic longitudinal section according to FIG. 6 after mounting of the microphone.

The microphone 1 is subsequently simply plugged into the opening 3, as depicted in FIG. 6 with the built-in position of microphone 1. Ring 2 applies therefore a friction fit to microphone 1 and thus retains and fixes microphone 1 in its position. A subsequent removal of microphone 1 is easy applicable by just pulling-out microphone 1.

Figure 7:
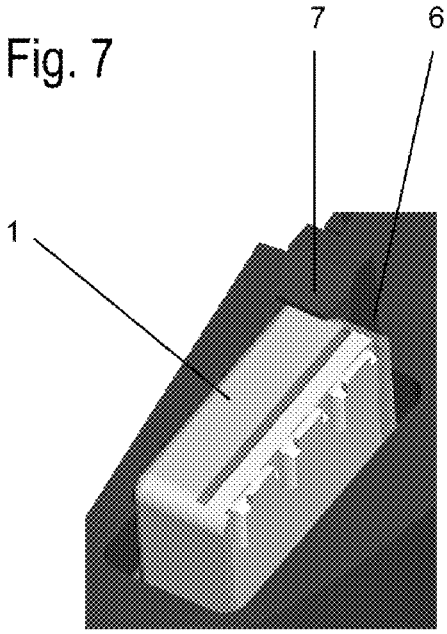
FIG. 7 is a schematic view onto a further alternative embodiment of an inventive hearing device with built-in microphone.

FIG. 7 shows the schematic view onto a further embodiment of the present invention with a microphone 1 inserted into its built-in position. Beside of the friction fit applied by ring 2 the microphone 1 is held additionally by an elastic tongue 6 with hook 7. This prevents securely of an unintentional or independent loosening of microphone 1 in the opening 3.

Figure 8:
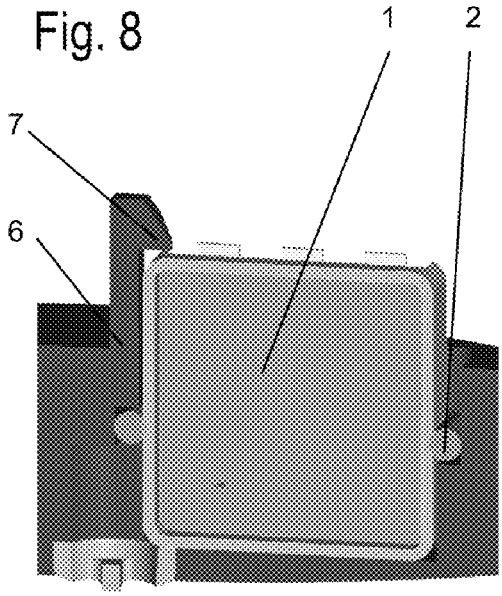
FIG. 8 is a longitudinal section through the embodiment of FIG. 7.

FIG. 8 depicts the longitudinal section of the embodiment of FIG. 7. It clearly shows the elastic tongue 6 protruding from the rim of opening 3 to the upper side. A hook 7 facing towards the opening 3 is provided at the head of tongue 6 to be brought into contact against the upper side of microphone 1 in its inserted position and thereby retaining microphone 1 additionally to the ring 2.

The invention claimed is:

1. Hearing device with at least one microphone arranged within the housing of the hearing device, wherein the microphone is arranged within a mounting plate of the hearing device, characterized in that an opening for receiving the microphone is provided within said mounting plate and that elastic material is arranged in at least a part of the area between said microphone and the wall of said opening facing said microphone, wherein an innermost dimension of the elastic material, in an installed position, is not less than an outermost dimension of said microphone.

2. Hearing device according to claim 1, characterized in that said elastic material is provided in the form of at least one band or ring surrounding said microphone.

3. Hearing device according to claim 1, characterized in that said elastic material is provided in the form of at least one band or ring surrounding the periphery of the cross section and arranged in the area of said wall of said opening.

4. Hearing device according to claim 1, characterized in that said band or ring provides a round or angular cross section.

5. Hearing device according to claim 1, characterized in that said microphone is provided in the form of a cubical shaped module.

6. Hearing device according to claim 1, characterized in that an inlet cross section of said opening is greater than the cross section of said microphone and that said elastic material is arranged in the area of the inlet cross section in its built-in state.

7. Hearing device with at least one microphone arranged within the housing of the hearing device, wherein the microphone is arranged within a mounting plate of the hearing device, characterized in that an opening for receiving the microphone is provided within said mounting plate and that elastic material is arranged in at least a part of the area between said microphone and the wall of said opening facing said microphone and that a pocket or a groove is provided within the wall of said opening for receiving said elastic material, whereby at least one part of the cross section of the elastic material is extending into the opening cross section of said opening.

8. The Hearing device according to claim 7, characterized in that the groove is provided as an open, surrounding groove facing up towards the insertion direction of the microphone.

9. Hearing device according to claim 1, characterized in that engaging means are arranged in the area of said opening to resiliently engage with the microphone in its built-in state.

10. Hearing device according to claim 9, characterized in that the engaging means comprise of a tongue resiliently facing outward from said mounting plate having a hook facing towards the opening cross section of said opening.

11. Hearing device according to claim 1, characterized in that said mounting plate is provided by the faceplate of an in-the-ear hearing device.

12. Microphone for a hearing device arranged within the housing of the hearing device, wherein the microphone is arranged within a mounting plate of the hearing device, characterized in that an opening for receiving the microphone is provided within said mounting plate and that elastic material is arranged in at least a part of the area between said microphone and the wall of said opening facing said microphone and at least one band or ring of elastic material surrounding said microphone, wherein the at least one band or ring of elastic material has an innermost dimension, in an installed position, that is not less than an outermost dimension of said microphone.

13. Microphone according to claim 12, characterized in that at least one part of the cross section of said band or ring is protruding out of the cross section of said microphone.

14. Microphone according to claim 12, characterized in that said band or ring is provided in the form of a bulge made out of elastic plastic material protruding from the outside of the housing of said microphone and at least partly extending along the periphery of the housing of said microphone.

15. Method for mounting a microphone within a hearing device, characterized by the following steps:

sliding on an elastic band or ring over said microphone, the elastic band or ring having an innermost dimension, in an installed position, that is not less than an outermost dimension of said microphone;

sliding in said microphone provided with said band or ring into an opening of the hearing device, thereby sliding said elastic band or ring into the area of said opening.

16. Method for mounting a microphone within a hearing device, whereby said microphone will be mounted into an opening of a mounting plate of the hearing device, characterized by the following steps:

inserting of an elastic band or ring into the opening, the elastic band or ring having an inner dimension, in an installed position, that is not less than an outermost dimension of said microphone;

sliding in said microphone into an inlet cross section provided by said band or ring within said opening.

* * * * *